US005551672A

United States Patent [19]

Schmidt

[11] Patent Number: 5,551,672

[45] Date of Patent: Sep. 3, 1996

[54] APPARATUS FOR CONTROLLING MOLTEN METAL FLOW IN A TUNDISH TO ENHANCE INCLUSION FLOAT OUT FROM A MOLTEN METAL BATH

[75] Inventor: Manfred Schmidt, Bethlehem, Pa.

[73] Assignee: Bethlehem Steel Corporation, Bethlehem, Pa.

[21] Appl. No.: 372,535

[22] Filed: Jan. 13, 1995

[51] Int. Cl.[6] ..... C21C 5/48

[52] U.S. Cl. ..... 266/229; 266/275; 222/594

[58] Field of Search ..... 266/227, 229, 266/236, 275, 44; 222/594

[56] References Cited

U.S. PATENT DOCUMENTS

| | | | |
|---|---|---|---|
| 3,814,167 | 6/1974 | Listhuber et al. | 164/82 |
| 3,887,171 | 6/1975 | Neuhaus | 266/34 R |
| 4,042,229 | 8/1977 | Thomas | 266/275 |
| 4,125,146 | 11/1978 | Muller et al. | 164/437 |
| 4,671,499 | 6/1987 | Ishiyama et al. | 266/275 |
| 4,711,429 | 12/1987 | Diederich et al. | 266/44 |
| 4,715,586 | 12/1987 | Schmidt et al. | 266/275 |
| 4,770,395 | 9/1988 | Vo Thanh | 266/275 |
| 4,776,570 | 10/1988 | Vo Thanh | 266/44 |
| 4,852,632 | 8/1989 | Jackson et al. | 164/437 |
| 4,993,692 | 2/1991 | Brown et al. | 266/229 |
| 4,995,592 | 2/1991 | Kegan et al. | 266/44 |
| 5,018,710 | 5/1991 | Soofi | 266/280 |
| 5,072,916 | 12/1991 | Soofi | 266/275 |
| 5,169,591 | 12/1992 | Schmidt et al. | 266/275 |
| 5,188,796 | 2/1993 | Soofi | 266/275 |
| 5,295,667 | 3/1994 | Soofi | 266/229 |
| 5,358,551 | 10/1994 | Saylor | 75/584 |

FOREIGN PATENT DOCUMENTS

| | | |
|---|---|---|
| 0481627 | 4/1992 | European Pat. Off. . |
| 0662362 | 7/1995 | European Pat. Off. . |
| 4205853 | 2/1992 | Germany . |
| 158259 | 12/1981 | Japan . |

OTHER PUBLICATIONS

"Taming the Thunder" by Jo Isenberg–O'Loughlin, Sep. 1994 33Metal Producing, pp. 21–23 and 47.

"Purifying steel in the tundish" by John Schriefer, Jan. 1995 New Steel, pp. 40–43.

*Primary Examiner*—Scott Kastler

*Attorney, Agent, or Firm*—Harold I. Masteller, Jr.

[57] ABSTRACT

Flow control apparatus for enhancing inclusion float out in a continuous caster tundish comprising a dam positioned downstream from an impact pad and an energy source positioned between the dam and the exit nozzle of the tundish. The dam receives an incoming flood of molten metal released from the impact pad and redirects the flood of molten metal into multiple sub-flow currents which carry entrained inclusions toward a slag cover on the surface of the molten metal bath to enhance inclusion float out. The energy source provides means to restore kinetic energy to the sub-flow currents and increase the number of passes below the slag cover, thereby further enhancing inclusion float out.

55 Claims, 3 Drawing Sheets

APPARATUS FOR CONTROLLING MOLTEN METAL FLOW IN A TUNDISH TO ENHANCE INCLUSION FLOAT OUT FROM A MOLTEN METAL BATH

BACKGROUND OF THE INVENTION

This invention is related to apparatus for controlling the direction of the molten metal flow within a continuous caster tundish, and more particularly, it relates to providing a molten metal flow pattern to enhance inclusion float out and improve the microcleanliness of a continuous cast steel product.

A tundish is a large tub like vessel located between a continuous caster mold and the ladle used to deliver liquid steel to the caster. The tundish is designed to hold a reservoir of liquid steel which flows from the tundish into the caster mold to form a product. During the transfer of molten metal to the tundish, via a shroud extending from the ladle, the incoming molten metal stream rebounds upward from the tundish floor and creates a turbulent boiling action which breaks up the slag cover on the surface of the bath, entrains slag cover particles within the steel, and exposes the steel to the atmosphere.

Applicants' U.S. Pat. No. 5,169,591 overcomes such turbulence and slag entrainment problems through the use of an impact pad shaped to reverse the direction of the fluid flow generated by the incoming ladle stream. The impact pad includes a base and a sidewall extending in an upward direction along the periphery of the base. The ladle stream impacts upon the base and generates a radiating fluid flow toward the sidewall, and the sidewall includes an undercut extending along its inside surface, and shaped to receive and reverse the direction of the radiating fluid flow back to ward the incoming ladle stream. The reversed fluid flow dissipates the energy of the fluid flow leaving the impact pad and reduces surface turbulence within the tundish. The reversed fluid flow also increases the likelihood of collisions between inclusions, and promotes coalescence and the formation of larger inclusion particles. The larger inclusion particles float out more rapidly due to their higher buoyancy.

Research directed to fluid flow in a tundish has led to the discovery that microcleanliness can be further improved in the steel product by using additional flow control apparatus in combination with impact pads. The new flow control apparatus creates gentle upward currents to enhance inclusion float out toward the slag cover floating on the surface of the liquid steel bath. These gentle currents are directed toward the bath surface at a reduced velocity to prevent surface boil and slag cover breakup. The coalesced inclusions in the steel stream flowing from the impact pad are carded toward the slag cover where they are absorbed and improve the microcleanliness of the steel product.

Combining different pieces of tundish furniture such as an impact pad with additional flow control dams reduces the turbulent flows that create surface boil. However, it also reduces the kinetic energy level of desired liquid steel flows downstream of the tundish furniture. As a result, directional control of the downstream steel is diminished, and the flow pattern in the downstream section of the tundish is dominated by the exit flow. Regions of the tundish bath in the vicinity of the end walls and particularly in the downstream corners are bypassed by the fluid flow, resulting in undesirable stagnation. To direct the fluid flow into these stagnant areas kinetic energy must be transferred to the fluid flow from an auxiliary energy source such as inert gas bubblers or electromagnetic stirrers. Apertures extending through the flow control dam can also reduce stagnation by allowing fluid with sufficient kinetic energy to pass through the dam.

The auxiliary energy sources are positioned downstream from the flow control dam between the dam and the tundish exit nozzle. They increase the kinetic energy level and the retention time for the liquid steel in the tundish, and create gentle upward currents without generating a surface boil. The apertures extending through the dam regulate the flow volume upstream and downstream of the dam.

SUMMARY OF THE INVENTION

It is therefore an object of this invention to improve the microcleanliness of a steel product by controlling the molten steel fluid flow within a continuous caster tundish.

It is a further object of this invention to improve the microcleanliness of a steel product by enhancing inclusion float out in a molten steel bath contained in a tundish.

It is still a further object of this invention to enhance inclusion float out by directing molten steel currents upward toward a slag cover on the bath surface.

It is still a further object of this invention to provide flow control apparatus for use in combination with a tundish impact pad to direct molten steel currents toward the slag cover and enhance inclusion float out.

It is still a further object of this invention to provide an energy source to maintain a continuous flow of molten steel currents toward the slag cover.

It is still a further object of this invention to reduce fluid flow stagnation in the downstream comers of a tundish.

And finally, it is a further object of this invention to provide an energy source to control the retention time of the molten steel flowing through the tundish.

We have discovered that the foregoing objects can be attained in a molten steel bath within a tundish by locating a flow control dam downstream from the tundish impact pad and positioning an energy source between the flow control dam and the tundish exit nozzle. The flow control dam includes upward pointing apertures and a shaped upper portion having undercut extending below an upstream pointing leg. The apertures direct molten steel currents a downstream direction toward the slag cover and dead volume areas at corners of the tundish, and the shaped upper portion directs molten steel currents in an upstream direction toward the slag cover and back into the impact pad. The energy source provides means to maintain a continuous flow of molten steel currents toward the slag cover.

DETAILED DESCRIPTION OF THE PREFERRED EMBODIMENT

The increased demand for cleaner steels has resulted in continuing research to advance methods and apparatus for improving the microcleanliness of certain steel grades. One such advancement in the art is the discovery of an impact pad for receiving and reversing the fluid flow generated by an incoming ladle stream as taught in applicants' prior U.S. Pat. No. 5,169,591. It has now been discovered that the microcleanliness of liquid steel can be further improved through the use of additional flow control apparatus in combination with the flow reversing impact pads.

Figure 1:
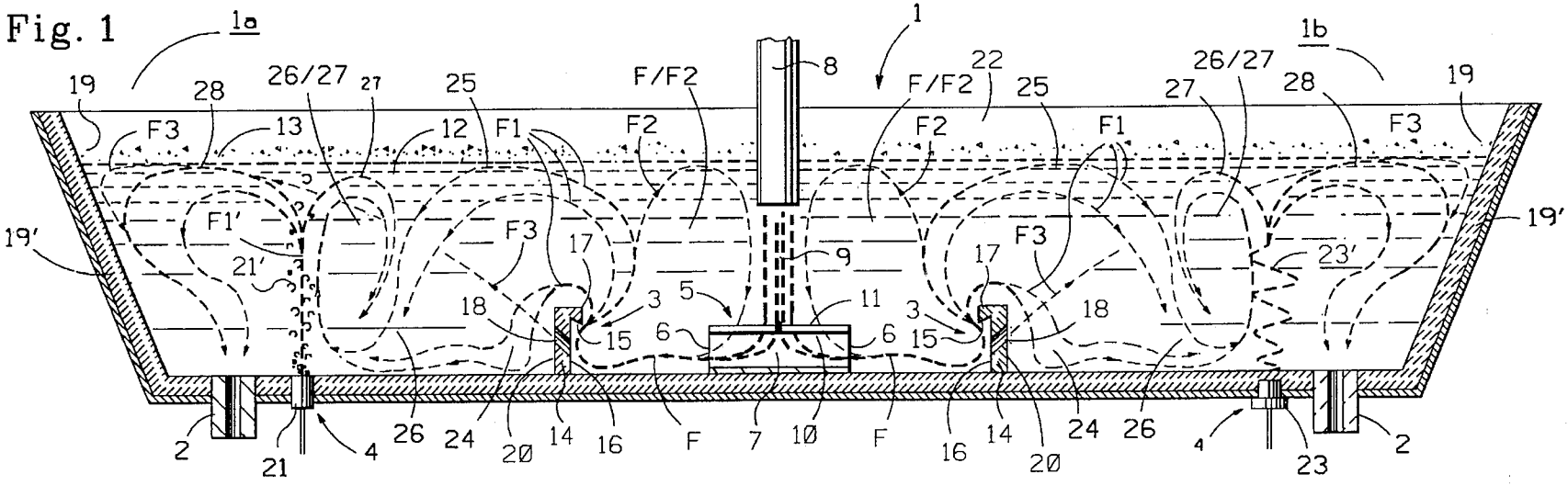
FIG. 1 is an elevation view in cross,section showing the preferred flow control apparatus for a multiple strand caster tundish.

Referring to FIG. 1 of the drawings, a multiple strand caster 1 is shown having a first end 1*a* and a second end 1*b*. The first and second ends are opposite hand, except, for the purpose of illustration, FIG. 1 shows different energy sources 4 imbedded within the tundish floor near the exit nozzles 2. In practice, however, a multiple strand caster tundish would have the same energy source 4 positioned adjacent each exit nozzle. Therefore, because the two ends are opposite hand, it should be understood that the following disclosure applies to both ends of the multiple strand caster tundish unless Otherwise indicated.

As shown in FIG. 1, the flow control apparatus of the preferred embodiment comprises a dam 3 and an energy source 4, in combination with a flow reversing tundish impact pad 5 that is located in the impact area of a tundish upon which an incoming ladle stream impacts. Impact pad 5 includes two openings 6 extending through sidewall 7 as shown in more detail in FIGS. 9–11 in U.S. Pat. No. 5,169,591. Molten steel is poured into tundish 1 via a ladle shroud 8 extending from a ladle (not Shown), and the fluid flow generated by the incoming ladle stream 9 is received by the undercut portion 10 extending along the inside surface of sidewall 7 below the top surface 11 of the pad. The undercut reverses the direction of the fluid flow back toward the incoming ladle stream 9 where its kinetic energy is dissipated. This reduces surface turbulence, as more clearly shown in FIGS. 6 and 7 of the drawings. The reversed fluid flow increases a likelihood for collisions to occur between inclusions entrained within the steel flow, and the inclusions coalesce to form larger particles which float out more rapidly toward the slag cover 13 floating on the surface of the steel bath.

Figure 2:
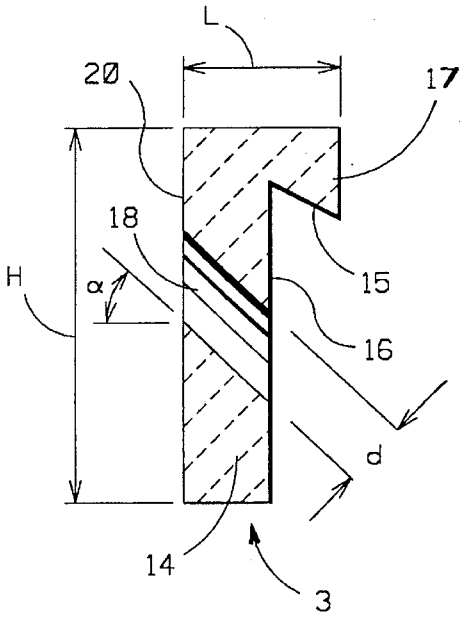
FIG. 2 is an elevation view in cross-section showing the dam portion of the flow control apparatus.

Flow control dam 3 is positioned downstream from impact pad 5 and extends at least part way along the width of tundish 1. The dam includes a vertical member 14 having an upstream surface 16 and a downstream surface 20. The vertical member 14 further includes an upper portion shaped different from its lower portion adjacent the tundish floor, the shaped upper portion comprising an upstream pointing leg 17 having an undercut 15. As more clearly shown in FIGS. 2 and 3, undercut 15 extends along the top portion of the vertical member 14 below the upstream extending leg 17, and undercut 15 and leg 17 are shaped to receive and redirect a flood of molten metal released from opening 6 extending through sidewall of the impact pad.

Figure 4:
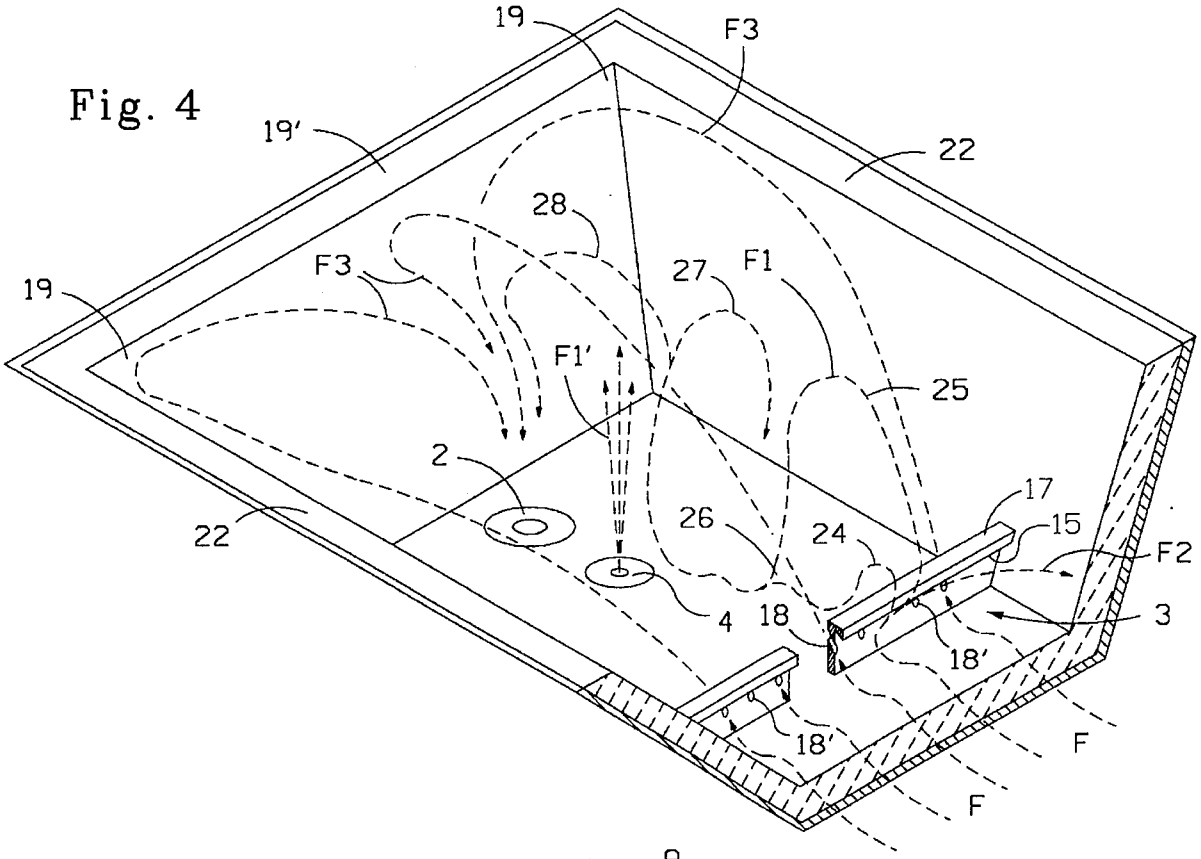
FIG. 4 is an isometric view of a portion of a tundish showing various sub-flow currents generated by the present flow control invention.
Figure 3:
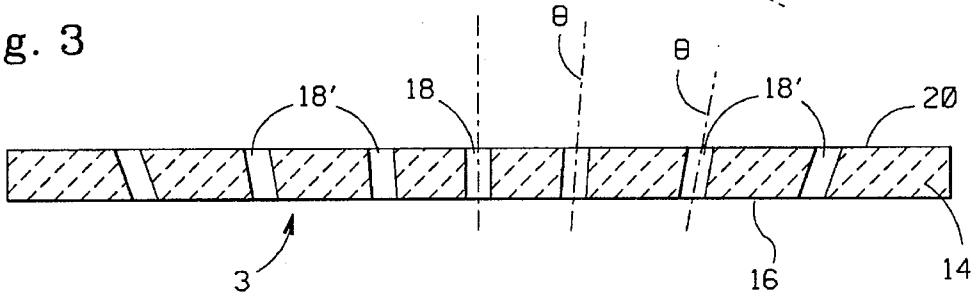
FIG. 3 is a plan view in Cross-section taken through the dam of the flow control apparatus.

As more clearly shown in FIGS. 3 and 4, the flow control dam further includes apertures 18 extending through wall 14. Apertures 18 extend through wall 14 in an upward direction from surface 16 to surface 20 at an angle $\alpha$ of 0° up to about 30°. The upward pointing apertures redirect a portion of the incoming fluid flow from impact pad 5 in an upward direction toward slag cover 13 at the bath surface.

The apertures may also extend through wall 14 at a compound angle $\theta$. The compound angle apertures 18' include the upward pointing angle $\alpha$ of 0° up to about 30° in combination with an outward pointing angle of up to about 60°. The outward pointing angle is pitched toward either tundish sidewall 22. Angle $\theta$ may vary from aperture to aperture, and any combination of apertures 18 and 18' may be used to fine tune the flow pattern of a particular tundish. The compound angle apertures 18' redirect a portion of the incoming fluid flow in an upward direction toward slag cover 13 as well as in an outward direction toward the downstream corners 19 of the tundish. The downstream corners are normally dead volume areas within the tundish and the currents generated by the apertures provide an improved flow pattern at the tundish end wall 19'.

The pitch of apertures 18 and 18' may vary to improve direction control of the sub-flow currents produced by the apertures.

Sub-flow currents refers to one or more lesser currents produced as a result of intercepting and dividing flood F into smaller parts. If apertures 18 and 18' are laid out properly for a specific tundish, the resulting sub-flow currents will flood end wall 19' with a gentle wash of molten steel and reduce or eliminate the dead volume zones at the downstream corners 19.

Referring once again to FIG. 1, at least one energy source 4 is located between the nozzle 2 dam 3. The energy source may include any presently known means, or future known means, capable of increasing the kinetic energy level of the sub-flow currents generated by the present flow control device. For example, the first end 1*a* of tundish 1 includes a gas bubbler 21. Such a device is capable of redirecting the sub-flow currents in the tundish by injecting a stream of inert gas 21' into the steel bath 12. However, the second end 1b of tundish 1 is shown having an electromagnetic stirrer 4. Such a device is capable of creating a gentle upward swirl 23' within the steel bath 12 to change the sub-flow current velocity.

As heretofore mentioned, reverse flow impact pads cause collisions between the inclusions entrained within the liquid steel bath, and these collisions produce larger, more buoyant particles which have better float out properties. However, in order to enhance float out conditions for these undesirable inclusions it is necessary to push the impurities toward the surface of the steel bath where they can be absorbed within the slag cover floating on the bath surface. To accomplish this the flow control dam 3 is located downstream from impact pad 5 at a position which will intercept most of the flood F released from open end 6 of the impact pad. The upstream surface 16 of wall 14 intercepts and dampens the incoming flood F, and apertures 18, undercut 15 and upstream extending leg 17 divide the dampened flood F into three sub-flow currents. A primary downstream sub-flow current F1, a reversed upstream sub-flow current F2, and downstream outward directed sub-flow current F3 directed toward corners 19. The primary sub-flow current F1 has the greatest flow volume and sub-flow current F3 has the lowest flow volume.

The combined cross-sectional area of all the apertures extending through leg 14 of the dam, the distance of the apertures from the tundish floor, and the pitch of the apertures determine the flow volumes for sub-flows F1, F2, and F3. For example, large apertures, having small angles α and short distances from the tundish floor, generate a large F3 sub-flow volume and reduce the F1 and F2 sub-flow volumes. Conversely, smaller apertures, having higher distances from the tundish floor, reduce the F3 sub-flow volume and generate larger F1 and F2 sub-flow volumes. Therefore, it can be seen that by properly sizing the diameter d of the apertures, the slope of angles α and θ, and the height of the aperture above the tundish floor, a wide range of flow adjustments may be provided Control fluid flow patterns to meet a variety of casting conditions. Additionally, further fluid flow control adjustments can be made by either increasing or decreasing the height H of leg 14 as the distance D between dam 3 and the upstream impact pad is either increased or decreased. And the length L and/or angle of the upstream point leg 17 of the dam 3 may also be adjusted to provide further means to control the fluid patterns within the tundish.

Figure 5:
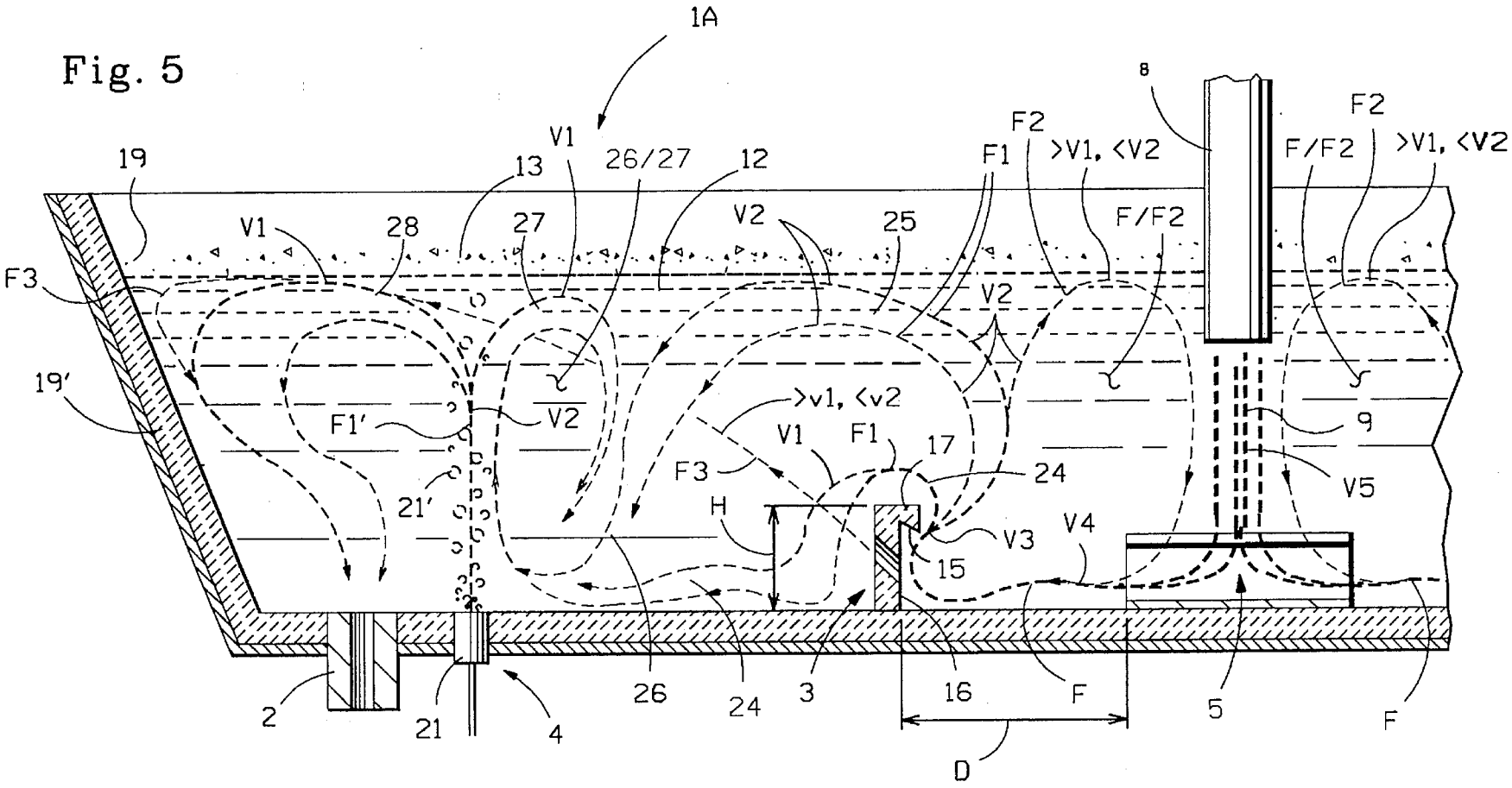
FIG. 5 is an enlarged portion of FIG. 1 showing velocity changes as the sub-flow currents move through the tundish.

Referring now to FIGS. 1, 4 and 5, the velocities of the incoming ladle stream 9, flood F, and sub-flow currents F1–F3 are measured on a scale from V0–V5, where V5 is the greatest flow volume and V0 is no measurable flow volume. Ladle stream 9 pours into the tundish at a flow volume of about V5, impacts upon the base of impact pad 5, and is reversed and dampened by undercut 10. Flood F is released from open end 6 extending through sidewall 7 and streams toward dam 3 at a flow volume within a range of about V4. Flood F impacts upon the upstream surface 16 of dam 3 and is further dampened and divided by apertures 18 and 18', undercut 15, and upstream leg 17 into the three sub-flow currents F1, F2, and F3.

Undercut 15 and leg 17 work together to redirect a portion of flood F upward into a partially reversed flow having a flow volume of about V3, and the partially reversed flow further divides into sub-flow currents F1 and F2. Sub-flow current F2 flows in an upstream direction at a flow volume range of about between V1 and V2. Sub-flow current F2 flows upstream just below slag cover 13. The sub-flow current F2 carries along some of the entrained inclusions and improves their likelihood for float out as they pass below the slag cover.

Sub-flow current F2 is pulled downward by the force of the incoming ladle stream 9 any remaining inclusions within sub-flow current F2 are recycled back into ladle stream 9. These remaining inclusions are then given an additional opportunity to coalesce and form into larger particles to improve their float out properties. In this way micro inclusions which fail to float out during a pass below slag cover 13 are given repeated cycles through impact pad 5 via the F/F2 loop. This greatly improves their chance for float out into the slag cover at the surface of the bath.

Primary sub-flow current F1 washes over leg 17 in a downstream direction at a flow volume range of about V1 up to about V2. The slower flowing portions of F1 pass over dam 3 and are pulled toward the exit nozzle as Shown at reference number 24. The faster flowing portions 25 of sub-flow current F1 are directed upward toward slag cover 13 at a flow volume of less than V2 which will not cause surface turbulence and/or slag cover break up. Sub-flow current F1 also carries entrained inclusion below slag cover 13 at a flow volume of about between V1 and V2 thereby also enhancing inclusion float out into the slag cover 13. As its flow volume drops below V1 portion 25 is pulled downward toward the exit nozzle and mixes with portion 24 as shown at 26. At this point dub-flow current F1 is either discharged through exit nozzle 2 into the caster mold, or an auxiliary energy source shown at 4 transfers kinetic energy to sub-flow F1 creating an additional upward sub-flow F1' toward the bath surface to carry remaining entrained inclusions on yet another pass just below slag cover 13 and thereby further enhancing inclusion float out into the slag cover.

Energy source 4 may include any suitable means known in the art. For the purpose of illustration, we have shown a gas bubbler 21 at end 1*a* and an electromagnetic stirrer 23 at end 1*b*. Energy source 4 is positioned between dam 3 and nozzle 2 and provides an upward current having a flow volume of about V2. This upward flow is capable of redirecting portion 26 of sub-flow current F1 in an upward direction toward slag cover 13. The refreshed upward flow of sub-flow current F1' divides into an upstream flowing current 27 and a downstream flowing current 28. Both currents 27 and 28 flow gently below slag cover 13 at a flow volume of about V1 and carry remaining entrained inclusions just below the slag cover to enhance inclusion float out into slag cover 13 for yet another time. The upstream flowing current 27 flows in a pattern similar to sub-flow current F2 in that it carries entrained inclusions toward the bath surface at a flow volume of about V1 and then falls toward the tundish floor forming a recycling loop 26/27. Many of the inclusions which fail to float out as current 27 flows below the slag cover are drawn downward into the circular loop to collide with incoming remaining inclusions from the falling portion 26 of sub-flow current F1. In this way most of the remaining inclusions are given repeated opportunities to coalesce and form larger particles to further improve their float out properties.

Downstream current 28 also flows below slag cover 13 at a flow volume of about V1 to enhance float out of any remaining inclusions entrained within the current. Current 28 is pulled toward the exit nozzle and falls to the tundish floor where a large part of the liquid steel is discharged through exit nozzle 2 into the caster mold.

Sub-flow current F3 radiates in a downstream direction from apertures 18 and 18' at a flow volume flow range of about between V1 and V2. The compound angle of apertures 18' direct the sub-flow current toward both the slag cover 13 and the downstream corners 19 of the tundish. Sub-flow current F3 carries some entrained inclusions on a downstream path just below slag cover 13 at a flow volume of about V1, however, the principal function of current F3 is to create a gentle wash along end wall 19', and in particular the end wall comers 19, to reduce stagnation in the dead volume areas.

As can be clearly seen in the drawings, each time a sub-flow current is directed toward slag cover 13, inclusion float out is enhanced, and the microcleanliness of the steel product is improved. However, it is well known that each tundish has inherent flow characteristics which vary from one tundish to another. The location and size of the dam, as well as the placement of the energy source is determined by these unique flow characteristics. In order to be more effective, the present flow control apparatus must be adjusted to fit the unique casting conditions of each tundish. In this way superior inclusion float out results can be achieved. For example, the casting rate, the ladle shroud height above the tundish floor, the shape and slope of tundish walls, and the impact pad design are just a few of the factors which affect fluid flow patterns within the tundish.

Figure 6:
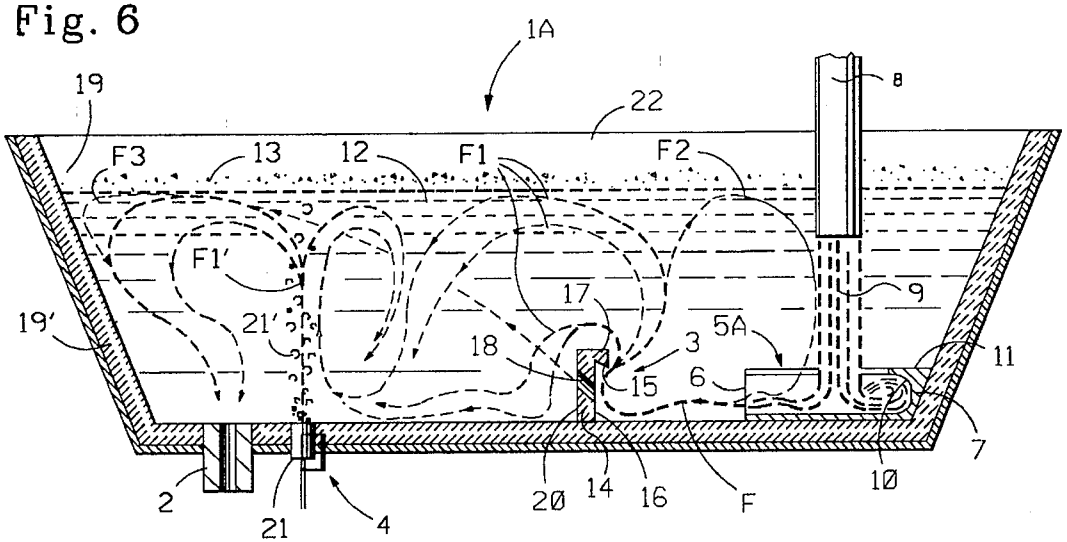
FIG. 6 is an elevation view in cross section showing the preferred flow control apparatus for a single strand caster tundish.

Referring now to FIG. 6, a second preferred embodiment of the tundish flow control invention is shown in a single strand caster 1A. The second preferred embodiment comprises a dam 3 extending at least part way along the width of the tundish and an energy source 4, in combination with a tundish impact pad 5A having one opening 6 extending through sidewall 7. The impact 5A is shown in more detail in U.S. Pat. No. 5,169,591.

The fluid flow generated by the incoming ladle stream 9 is received by the undercut portion 10 of impact pad 5A. Undercut 10 extends along the inside surface of sidewall 7 below top surface 11, and the top surface 11 extends along three sides of the impact pad. The undercut reverses and dampens the incoming fluid flow to reduce surface turbulence as described above for the multiple strand caster tundish 1.

Flow control dam 3 of the second embodiment is positioned downstream from impact pad 5A, and dam 3 includes a vertical wall 14 having an upstream surface 16 and a downstream surface 20, an undercut 15, and an upstream extending leg 17. Undercut 15 and leg 17 are shaped to receive and redirect flood F released from open end 6 of the impact pad 5A. It should be understood, however, that although undercut 15 is shown as a sloped planer surface, any suitable configuration such as a curved surface could be used to redirect flood F.

As disclosed for the multiple caster tundish 1 dam 3 intercepts the incoming flood F and divides it into three sub-flow currents. A primary downstream sub-flow current F1 having the greatest flow volume of the three sub-flow currents, an upstream sub-flow current F2, and downstream outward directed sub-flow current F3 having the smallest flow volume. The three sub-flow currents flow in a pattern similar to that described for tundish 1, and as before, the energy source 4 is positioned between dam 3 and tundish nozzle 2 to provide a refreshed sub-flow current F1'.

Figure 7:
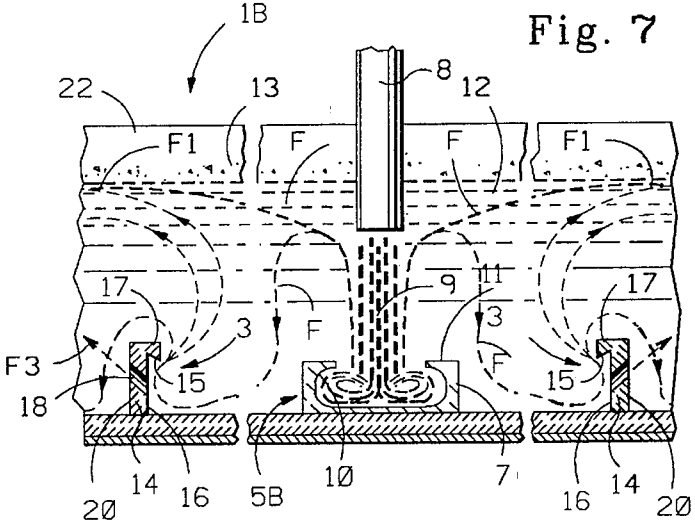
FIG. 7 is an alternate embodiment of the present flow control invention for a caster tundish.

Referring to FIG. 7 of the drawings, a still further embodiment of the present tundish flow control invention is shown for use in a multiple strand caster 1B. This third embodiment comprises dams 3 and energy sources 4 (not shown), in combination with a tundish impact pad 5B having a continuous sidewall 7.

The fluid flow generated by the incoming ladle stream 9 is received by the undercut portion 10 of impact pad 5B. Undercut 10 extends along the inside surface of sidewall 7 below top surface 11, and surface 11 extends along the entire periphery of the impact pad. The undercut reverses and dampens the incoming fluid flow as before, but it does not direct flood F in a clearly defined path as in the two earlier preferred embodiments.

Dam 3 of the third embodiment is positioned downstream from impact pad 5B, and dam 3 extends at least part way along the width of tundish 1B. The dam includes a vertical wall 14 having an undercut portion 15 and an upstream extending leg 17 for receiving some part of the dampened flood F released from impact pad 5B. However, unlike the earlier two preferred embodiments which have at least one opening extending through their sidewall 7, continuous sidewall 7 extending along the entire periphery of impact pad 5B does not give direction to flood F. Surface 16 of the dam 3 intercepts a portion of flood F emitted from the impact pad 5B. It appears from water model tests that at best flood F is divided into two sub-flow currents. A primary downstream flowing current F1 and the smaller downstream sub-flow current F3 directed to corners 19 of the tundish. As can be seen by comparing this embodiment to the drawings of the two preferred embodiments, when dam 3 is used in combination with impact pad 5B sub-current F2 is eliminated, loop F/F2 is no longer present to recycle remaining inclusions through the impact pad area, and opportunities for inclusion float out are reduced. As a result, the continuously cast steel product produced by the third embodiment is less clean than the product produced using the embodiments shown in FIG. 1 and FIG. 6.

While this invention has been described as having a preferred design, it is understood that it is capable of further modifications, uses and/or adaptations of the invention, following the general principle of the invention and including such departures from the present disclosure as come within known or customary practice in the art to which the invention pertains, and as may be applied to the central features herein before set forth, and falls within the scope of the appended claims.

I claim:

1. Flow control apparatus for use with an impact pad in a continuous caster tundish containing a liquid steel bath comprising:

a dam positioned downstream from said impact pad including;

a) an upper portion shaped to receive and redirect a flood of molten metal released from said impact pad into at least one sub-flow current toward a slag cover floating on said liquid steel bath, and b) at least one aperture extending through said dam at a compound angle including an upward angle $\alpha$ and outward angle $\theta$.

2. The flow control apparatus of claim 1 wherein said upper portion includes an upstream extending leg.

3. The flow control apparatus of claim 2 wherein said upper portion includes an undercut below said upstream extending leg, said undercut shaped to redirect said flood of molten metal into at least one sub-flow current toward said slag cover.

4. The flow control apparatus of claim 1 wherein said upward angle $\alpha$ directs at least one sub-flow current toward said slag cover and said outward angle $\theta$ directs at least one sub-flow current in an outward direction toward a downstream corner of said continuous caster tundish.

5. The flow control apparatus of claim 17 wherein said upward angle $\alpha$ is between 0° and 30° and said outward angle $\theta$ is between 0° and 60°.

6. Flow control apparatus for use with an impact pad in a continuous caster tundish containing a liquid steel bath comprising: a dam positioned downstream from said impact pad including;

an upper portion and a lower portion opposite said upper portion, said upper portion having a leg projection outwardly from said dam toward said impact pad, said leg shaped to receive and redirect a flood of molten metal released from said impact pad, into at least one sub-flow current flowing in a downstream direction away from said impact pad and upward toward a slag cover floating on said liquid steel bath and into at least one sub-flow current flowing in an upstream direction toward said impact pad and upward toward said slag cover.

7. The flow control apparatus of claim 6 wherein said upper portion includes an undercut below said leg, said undercut shaped to receive and redirect the flood of molten metal released from said impact pad.

8. The flow control apparatus of claim 6 wherein said dam includes at least one aperture extending through said dam to redirect said flood of molten metal into at least one sub-flow current toward said slag cover.

9. The flow control apparatus of claim 8 wherein said at least one aperture extends through said dam at an upward angle $\alpha$.

10. The flow control apparatus of claim 9 wherein said upward angle α is between 0° and 30°.

11. The flow control apparatus of claim 8 having at least one aperture extending through said dam at a compound angle including an upward angle α to direct said at least one sub-flow current toward said slag cover and an outward angle θ toward a sidewall of said continuous caster tundish to redirect at least one sub-flow current in an outward direction toward a downstream corner of said continuous caster tundish.

12. The flow control apparatus of claim 11 wherein said upward angle α is between 0° and 30° and said outward angle θ is between 0° and 60°.

13. The flow control apparatus of claims 1 or 6 having at least one energy source positioned between said dam and an exit nozzle in said continuous caster tundish.

14. The flow control apparatus of claim 13 where said at least one energy source is a gas bubbler.

15. The flow control apparatus of claim 13 where said at least one energy source is an electromagnetic stirrer.

16. The flow control apparatus of claim 13 wherein said upper portion includes an upstream extending leg.

17. The flow control apparatus of claim 16 wherein said upper portion includes an undercut below said upstream extending leg, said undercut shaped to redirect said flood of molten metal into at least one sub-flow current toward said slag cover.

18. The flow control apparatus of claim 13 wherein said dam includes at least one aperture extending through said dam to redirect said flood of molten metal into at least one sub-flow current toward said slag cover.

19. The flow control apparatus of claim 18 wherein said aperture extends through said dam at an upward angle.

20. The flow control apparatus of claim 19 wherein said upward angle α is between 0° and 30°.

21. The flow control apparatus of claim 18 having at least one aperture extending through said dam at a compound angle including an upward angle α to direct said at least one sub-flow current toward said slag cover and an outward angle θ toward a sidewall of said continuous caster tundish to redirect at least one sub-flow current in an outward direction toward a downstream corner of said continuous caster tundish.

22. The flow control apparatus of claim 20 Wherein said upward angle α is between 0° and 30° and said outward angle θ is between 0° and 60°.

23. The flow control apparatus of claim 13 wherein said at least one energy source provide energy to redirect at least one sub-flow current in a downstream direction toward said slag cover, and at least one sub-flow current in an upstream direction toward said slag cover.

24. In a continuous caster tundish having improved flow control apparatus to enhance float out of inclusions entrained within a molten metal bath, the improved flow control apparatus comprising; a dam positioned downstream to receive a flood of molten metal released from an upstream impact pad, said dam having;

a) an upper portion shaped to divide said flood of molten metal into multiple sub-flow currents, said upper portion redirecting at least one currents in an upward direction to flow below a slag cover to enhance inclusion float out from said molten metal bath to said slag cover, and b) at least one aperture extending through said dam at a compound angle including an upward angle α and an outward angle θ.

25. The continuous caster tundish of claim 24 wherein said upper portion includes an upstream extending leg to redirect at least one of said multiple sub-flow currents upward to pass below said slag cover to enhance said inclusion float out.

26. The continuous caster tundish of claim 25 wherein said upper portion includes an undercut below said upstream extending leg, said undercut shaped to redirect at least one of said multiple sub-flow currents upward to pass below said slag cover to enhance said inclusion float out.

27. The continuous caster tundish of claim 24 wherein said upward angle α directs at least on sub-flow current toward said slag cover to enhance said inclusion float out, and said outward angle θ directs at least one sub-flow current in an outward direction toward at least one end wall corner of said continuous caster tundish to reduce dead volume areas at said at least one end wall corner.

28. The continuous caster tundish of claim 24 wherein said upward angle α is between 0° and 30° and said outward angle θ is between 0° and 60°.

29. In a continuous caster tundish having sidewalls and a floor to receive molten metal and improved flow control apparatus to enhance float out of inclusions entrained within the molten metal, the improved flow control apparatus comprising;

a) a dam positioned downstream from an impact pad to receive a flood of molten metal released from said impact pad, said dam having an upper portion and a lower portion adjacent the floor of the tundish and opposite said upper portion, said upper portion having a leg projecting outwardly from said dam toward said impact pad, said leg shaped to divide the flood of molten metal into multiple sub-flow currents including, i) at least one sub-flow current directed downstream away from said impact pad and in an upward direction to flow below a slag cover to enhance inclusion float out from the molten metal to the slag cover, and ii) at least one sub-flow current directed upstream toward said impact pad and in an upward direction to flow below the slag cover to enhance inclusion float out from the molten metal to the slag cover.

30. The continuous caster tundish of claim 29 wherein said upper portion includes an undercut below said leg, said undercut shaped to redirect said multiple sub-flow currents.

31. The continuous caster tundish of claim 29 wherein said dam includes at least one aperture extending through said dam to redirect said flood of molten metal into at least one sub-flow current toward said slag cover to enhance said inclusion float out.

32. The continuous caster tundish of claim 31 wherein said at least one aperture extends through said dam at an upward angle α.

33. The continuous caster tundish of claim 32 wherein said upward angle α is between 0° and 30°.

34. The continuous caster tundish of claim 31, wherein at least one aperture extending through said dam at a compound angle including an upward angle α to direct at least one sub-flow current toward said slag cover to enhance said inclusion float out, and an outward angle θ toward a sidewall of said continuous caster tundish to redirect at least one sub-flow current in an outward direction toward at least one end wall corner of said continuous caster tundish to reduce dead volume areas at said at least one end wall corner.

35. The continuous caster tundish of claim 34 wherein said upward angle α is between 0° and 30° and said outward angle θ is between 0° and 60°.

36. The continuous caster tundish of claims 24 or 29 having at least one energy source positioned between said dam and a exit nozzle in said continuous caster tundish.

37. The continuous caster tundish of claim 36 where said at least one energy source is a gas bubbler.

38. The continuous caster tundish of claim 36 where said at least one energy source is an electromagnetic stirrer.

39. The continuous caster tundish of claim 36 wherein said upper portion includes an undercut below said leg, said undercut shaped to redirect, said multiple sub-flow currents.

40. The continuous caster tundish of claim 36 wherein said dam includes at least one aperture extending through said dam to redirect said flood of molten metal into at least one sub-flow current toward said slag cover to enhance said inclusion float out.

41. The continuous caster tundish of claim 40 wherein said at least one aperture extends through said dam at an upward angle α.

42. The continuous caster tundish of claim 41 wherein said upward angle α is between 0° and 30°.

43. The continuous caster tundish of claim 36 wherein at least one aperture extending through said dam at a compound angle including an upward angle α to direct at least one sub-flow current toward said slag cover to enhance said inclusion float out, and an outward angle θ toward a sidewall of said continuous caster tundish to redirect at least one sub-flow current in an outward direction toward at least one end wall corner of said continuous caster tundish to reduce dead volume areas at said at least one end wall corner.

44. The continuous caster tundish of claim 43 wherein said upward angle α is between 0° and 30° and said outward angle θ is between 0° and 60°.

45. The flow control apparatus of claim 1 wherein said dam redirects at least one sub-flow current back into said upstream impact pad, said at least one sub-flow current becoming part of said flood of molten metal released from said impact pad.

46. The flow control apparatus of claim 6 wherein said dam redirects at least one sub-flow current back into said upstream impact pad, said at least one sub-flow current becoming part of said flood of molten metal released from said impact pad.

47. The continuous caster tundish of claim 24 wherein said dam redirects at least one of said multiple sub-flow currents back into said up stream impact pad, said at least one of said multiple sub-flow current becoming part of said flood of molten metal released from said impact pad.

48. The continuous caster tundish of claim 29 wherein said dam redirects at least one sub-flow current back into said upstream impact pad, said flood of molten metal released from said impact pad.

49. Flow control apparatus for use in a continuous caster tundish containing a liquid steel bath comprising: a dam for receiving a flood of molten metal from an impact area of a tundish including;

at least one aperture extending through said dam at a compound angle having an upward angle α and an outward angle θ.

50. The flow control apparatus of claim 49 wherein said upward angle α is between 0° and 30° and said outward angle θ is between 0° and 60°.

51. The flow control apparatus of claim 49 wherein said dam includes an upper portion and a lower portion opposite said upper portion, said upper portion shaped different than said lower portion to receive and redirect said flood of molten metal into at least one sub-flow current.

52. In a continuous caster tundish having an impact area upon which an incoming ladle stream impacts, improved flow control apparatus to enhance inclusion float out from molten metal contained in the tundish to a slag cover, the improved flow control apparatus comprising: a dam positioned downstream from an impact area, said dam including;

a) at least one aperture extending through said dam at a compound angle including an upward angle α and an outward angle θ.

53. The continuous caster tundish of claim 52 wherein said upward angle α directs at least one sub-flow current toward said slag cover to enhance said inclusion float out, and said outward angle θ directs at least one sub-flow current in an outward direction toward at least one end wall corner of said continuous caster tundish to reduce dead volume areas.

54. The continuous caster tundish of claim 52 wherein said upward angle α is between 0° and 30° and said outward angle θ is between 0° and 60°.

55. The continuous caster tundish of claim 52 wherein said dam includes an upper portion and a lower portion opposite said upper portion, said Upper portion shaped different than said lower portion to receive and redirect said flood of molten metal into multiple sub-flow currents, at least one of said multiple sub-flow currents directed in an upward direction to flow below a slag cover m enhance inclusion float out from said molten metal to said slag cover, and at least one sub-flow current directed upstream back into said impact area.

* * * * *